United States Patent [19]

Lantermann

[11] 4,212,599

[45] Jul. 15, 1980

[54] METHOD AND DEVICE FOR REGULATING THE OUTPUT QUANTITY OF COMPRESSED MEDIUM OF SINGLE AND MULTI-STAGE SCREW AND TURBO COMPRESSOR SYSTEMS

[75] Inventor: Heinz Lantermann, Kirchhellen, Fed. Rep. of Germany

[73] Assignee: Gutehoffnungshütte Sterkrade Aktiengesellschaft, Fed. Rep. of Germany

[21] Appl. No.: 934,889

[22] Filed: Aug. 18, 1978

[30] Foreign Application Priority Data

Aug. 20, 1977 [DE] Fed. Rep. of Germany ..... 2737677

[51] Int. Cl.[2] ..... F04C 29/10

[52] U.S. Cl. ..... 417/295; 417/303

[58] Field of Search ..... 417/290, 295, 303

[56] References Cited

U.S. PATENT DOCUMENTS

| | | | |
|---|---|---|---|
| 862,867 | 8/1907 | Eggleston | 417/390 |
| 1,519,995 | 12/1924 | Wineman | 417/295 |
| 3,043,495 | 7/1962 | Hewitt | 417/295 X |
| 3,226,011 | 12/1965 | Gustafson | 417/295 |
| 3,961,862 | 6/1976 | Enstron et al. | 417/295 |

*Primary Examiner*—Richard E. Gluck
*Attorney, Agent, or Firm*—McGlew and Tuttle

[57] ABSTRACT

A method of regulating the output quantity of compressed medium of single and multi-stage screw and turbo compressor systems, comprises, throttling the suction to the compressor systems with a throttling valve by fluid-pressure operation of the valve, sensing the pressure of the discharge of the compressor systems, closing the throttle valve in accordance with the pressure which is sensed and bleeding the medium after it is passed through the compressors and in a proportion to the pressure which is sensed and only after the throttling valve is moved through a proportional closing movement. The device for operating the compressor systems for regulating the quantity of medium includes a throttle valve in the suction having a valve member movable between opened and closed positions and with a control piston connected to the throttle valve to shift the valve member. A bleed valve has a passage connected to the discharge at one end and to the atmosphere at its opposite end, with valve seats in the passage closable by valve means which are connected to the control piston and movable in the passage toward and away from the valve seat means for opening and closing the passage. The valve and the valve seat means provide a lost motion connection to the control piston so that the control piston is movable to move the valve means in an opening direction to open the passage only after the throttle is moved in a closing direction to take up the lost motion connection.

10 Claims, 2 Drawing Figures

METHOD AND DEVICE FOR REGULATING THE OUTPUT QUANTITY OF COMPRESSED MEDIUM OF SINGLE AND MULTI-STAGE SCREW AND TURBO COMPRESSOR SYSTEMS

FIELD AND BACKGROUND OF THE INVENTION

This invention relates to screw compressors in general and, in particular, to a new and useful method and device to regulate the quantity of compressed medium delivered by single and multiple stage screw compressors and combinations of single stage turbo compressors and single or multiple stage screw compressors.

DESCRIPTION OF THE PRIOR ART

A regulating device for a centrifugal compressor is known from German Pat. No. 908,657, wherein, a slow-acting blow-off regulator is combined with a fast acting regulating device which, at times, opens the hydraulically controlled blow-off device more than is necessary. The throttle mounted in the pressure line in a closed position likewise effects a blow-off of the medium pumped in excess. The disadvantage of this device is the complicated, and, therefore, trouble-prone design, and the high energy losses which occur through the blowing off.

German provisional Pat. No 1,094,915 describes a regulating device for turbo machines. The device of this disclosure has a coarse regulator for the rotor blade or guide vane adjustment and an additional fine regulator which regulates a hydraulically controlled throttle valve disposed in the suction line as a function of the final pressure. This device is unsuitable for single and multiple stage screw compressors and for combinations of single stage turbo compressors and single or multiple stage screw compressors, because a coarse regulation through guide vane or rotor blade adjustment between the various compression stages is senseless.

SUMMARY OF THE INVENTION

The present invention provides a simple and economically working regulator for screw compressors or combinations of single stage turbo compressors and single or multiple stage screw compressors which uses the proven components for regulation of centrifugal and turbo compressors, while avoiding the disadvantages of the prior art.

The problem underlying the present invention is the development of a method and device for the execution of the method to regulate the quantity delivered by single or multiple stage screw compressors or combinations of single stage turbo compressors and single or multiple stage screw compressors in order to largely prevent energy losses inexpensively, through blow-off under changing loads from the consuming devices, using components which are known per se. In order to solve this problem, a method is proposed whereby a bleed valve is only opened after the throttle valve located in the suction to the compressors, has reached a position in which the valve is at a closing angle.

The execution of the method is accomplished by a device in which the bleed valve, designed as a double seat valve, and the throttle valve have a common hydraulic drive and form one structural unit. An unclutered and largely trouble-free regulation of the quantity delivered by the screw compressors is thus achieved. The common hydraulic drive is equipped with a double-acting piston having different piston areas whose upper, smaller area is constantly acted upon by the hydraulic or liquid pressure fluid of the fluid supply forming part of the operating readiness of the compressor to keep the throttle valve open.

The lower annular chamber of the hydraulic cylinder with the larger piston area communicates with the hydraulic fluid supply through a pressure regulator acted upon by the pumped gaseous medium. The pressure regulator releases hydraulic fluid as a function of discharge pressure fluctuations. A hydraulic fluid throttle is shunted between the pressure regulator and the hydraulic cylinder. The throttle equalizes the pressure regulator's pressure pulses so that, when the discharge pressure increases, a closing pressure for the throttle valve, upstream of the compressor, builds up continually in the lower annular chamber of the hydraulic cylinder. The bleed valve stem is designed as a piston rod extension of the bleed valve which, in turn, is also designed as a double-seat valve, and supports the adjusting lever for the throttle valve at its upper end; its lower end penetrates and slides in a double seat cone to which it is joined by a cylindrical pin.

The design of the double seat cone, both sides of which are acted upon by the gaseous compressed medium, is such that its valve seats are approximately balanced as far as forces are concerned, but have a slight tendency to open. A spring which permits the double seat cone to move axially is disposed between the penetrating and sliding valve stem and the double seat cone. The motion is limited by an elongated hole located in the valve stem. The cylindrical pin slides in the elongated hole. The preload brought about by the spring keeps the double valve cone closed for the spring travel corresponding to the length of the elongated hole. At the same time, the length of the elongated hole determines the position of the closing angle of the throttle valve.

Accordingly, it is an object of the invention to provide a device for operating compressor systems for regulating the quantity of medium taken in through a suction of single and multi-stage screw and turbo-compressor systems and discharge through a discharge which comprises a throttling valve in the suction having a valve member movable between opened and closed positions and a control piston connected to the throttle valve to shift the valve and which also includes a bleed valve having a passage connected to the discharge and to atmosphere with valve seat means in the passage and valve means connected to the control piston movable in the passage toward and away from the valve seat means for opening and closing the passage and, wherein, the valve and the valve seat means provide a lost motion connection to the control piston so that the piston is movable to move the valve means toward an open position to open the passage only after the throttle valve is moved in a closing direction and the lost motion connection is taken up.

A further object of the invention is to provide a method of regulating the output of a quantity of compressed medium of single and multi-stage screw and turbo compressors which comprises throttling the suction to the compressor systems with a throttling valve by fluid pressure operation of the valve, sensing the pressure of the discharge of the compressor systems, closing the throttling valve in accordance with the pressure sensed, and bleeding the medium after it has passed through the compressors in proportion to the pressure which is sensed and only after the throttling valve is moved through a proportional closing movement.

Another object of the invention is to provide a device for regulating the output quantity of compressed medium of single and multi-stage screw and turbo compressor systems, which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
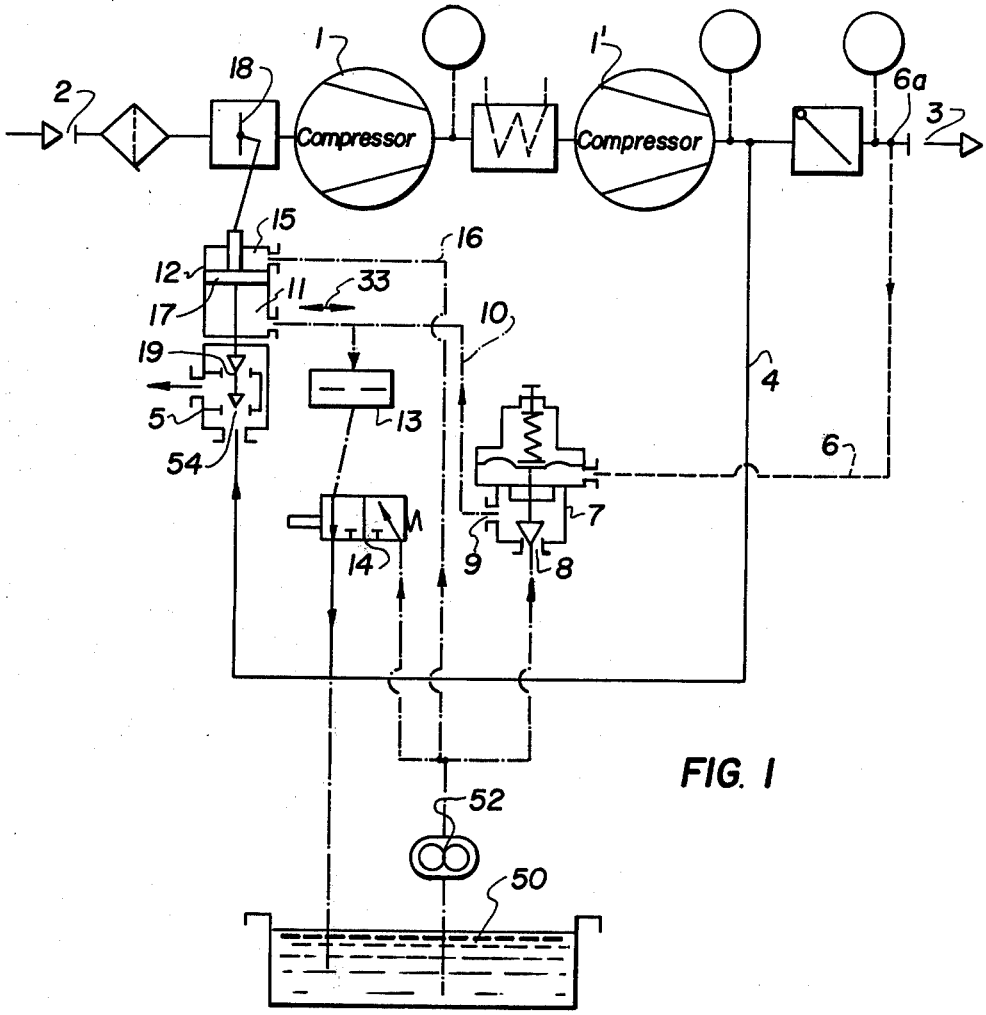
FIG. 1 is a schematic diagram of a two-stage screw compressor system, constructed in accordance with the invention.

Referring to the drawings in particular, the invention embodied therein, comprises, a method of regulating the output quantity of a compressed medium of single and multi-stage screw and turbo-compressors, such as the two-stage compressors 1 and 1' shown in FIG. 1, which have an inlet or suction 2, which is provided wih a throttling valve 18 and an outlet or discharge 3 having a pressure takeoff or tap 6a therein before the discharge.

Throttle valve 18 is regulated by a control piston 17 which is shiftable in a cylinder or housing 12 and is connected to the throttle valve 18 in order to open and close it in accordance with the position of the control piston. The position of the control piston is varied in accordance with pressure conditions existing in a lower chamber portion 11 and in an upper chamber portion 15 on respective sides of the control piston.

A fluid pressure is employed for the control and, in the embodiment shown, a liquid 50 is pumped out from a reservoir by a pump 52 to provide a fluid control pressure in chamber 15 and the lower chamber 11 is subjected to pressure from a line 10 leading from a pressure regulator 7 which is connected through a line 6 to the pressure takeoff 6a of the discharge 3. The fluid which flows in through an inlet 8 of a pressure regulator 7 may be discharged througn an outlet 9 and the line 10 into the lower chamber 11, as necessary.

In accordance with the invention, the control piston 17 is connected to a valve means 29 which are engageable with valve seat means 54 of a bleed valve 5. A lost motion connection, generally designated 56, is provided between the valve means 29 and the valve seat means 54. In the embodiment shown, the lost motion connection comprises a spring system 22 which is connected to a driver having a pin 24 engaged in a slot 23 of a valve stem 19.

The two-stage screw compressor 1 attracts at 2, the medium to be compressed and delivers it at 3 to a supply network (not shown). Line 4 connects the pressure discharge side of the screw compressor to the bleed valve 5. Line 6 transmits the fluctuating discharge pressure to the pressure regulator 7 which releases the fluid pressure prevailing at 8 from the pressure fluid supply forming part of the operating readiness of a screw compressor when the pressure increases due to reduced consumption.

The fluid flow is conducted to a lower annular chamber 11 of a hydraulic cylinder 12 through an outlet 9 of the regulator 7 and line 10, with a part being returned to the fluid tank through the shunted fluid throttle 13 and the solenoid or magnetic valve 14 set for passage. The upper annular chamber 15 is constantly supplied with pressure fluid. Since the lower active surface of control piston 17 in the cylinder 12 is larger than the upper one, control piston 17 would immediately be moved upwardly upon every release of pressure fluid by the pressure regulator 7, thereby, actuating a throttle valve 18 disposed in the suction line of the compressor 1. The switching frequency would therefore become very high, if the fluid throttle 13 was not used for equalization. Thus, the job of the fluid throttle 13 is to convert the unidirectional fluid flow emanating from pressure regulator 7 into a fluid flow moving back and forth between the lower annular chamber 11 and the fluid throttle 13, as indicated by the double arrow 33. At a rising tendency of the discharge pressure, pressure is continually being built up in the lower annular chamber 11 of hydraulic cylinder 12, moving control piston 17 upwardly and controlling throttle valve 18 in the "closing" direction.

The effect of the bleed valve 5 is described below: Since the effective throughput of the screw compressor is being reduced by throttling the suction flow, the discharge pressure also drops, and the pressure regulator 7 releases less fluid. Fluid flows back from the lower annular chamber 11 of the hydraulic cylinder 12 through fluid throttle 13, because the constant fluid pressure in upper annular chamber 15 returns the control piston 17 and, with it, the throttle valve 18, into a position commensurate with the discharge pressure.

Figure 2:
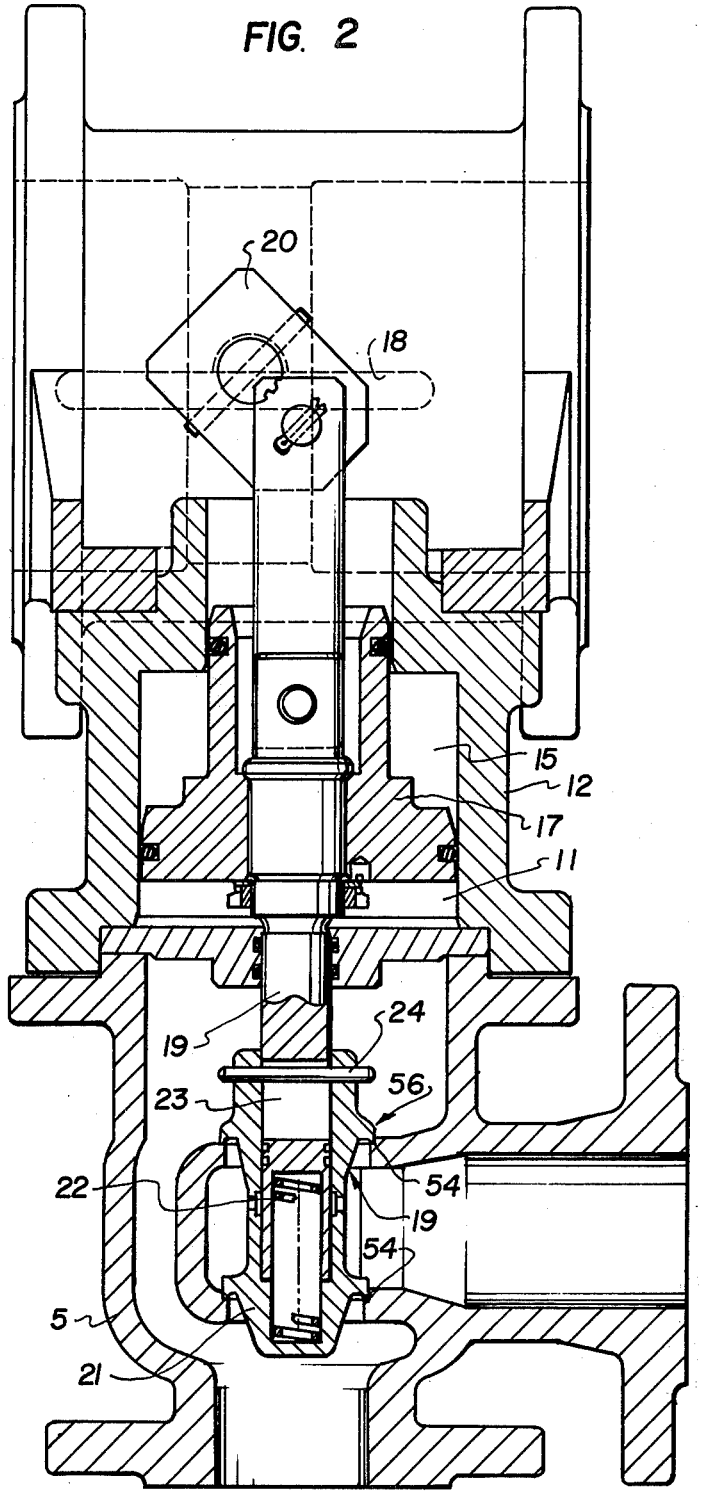
FIG. 2 is an enlarged transverse sectional view of the combined throttle control piston and bleeding valve construction for use in the system of FIG. 1.

As shown in FIG. 2, the bleed valve 5 is designed as a double-seat valve, whose valve seats are approximately balanced as far as forces are concerned because pressure is exerted on both sides by the compressed medium, and both have a slight tendency to open. The valve stem 19, being the extended piston rod of the control piston 17 supports an adjusting lever 20 at its upper end for the throttle valve 18. The stem 19 penetrates, slides in, and is joined by a cylindrical pin 24 to the axially movable double seat cone 21 which is preloaded by a spring 22. An elongated slot 23 in the valve stem 19, in which the cylindrical pin 24 slides, permits the spring to travel a certain distance. The spring 22 is designed so that the double seat cone 21 keeps the bleed valve 5 closed through a spring travel corresponding to the length of the elongated slot 23.

Now, if due to increasing discharge pressure, the pressure regulator 7 releases a fluid flow which controls the throttle valve 18 in the "closing" direction through the control piston 17, the bleed valve remains closed for a distance corresponding to the length of the elongated slot 23, whereas, the throttle valve 18 has already reached a certain closing angle. Only when a maximum temperature is reached in the pressure or discharge line is the magnetic valve 14 switched via a thermostat or pressure ratio monitor and the throttle valve 18 closed. The double seat cone 21 is then raised and the bleed valve 5 is thus opened to atmosphere and the machine idles. Reswitching to operation under load occurs through the lower switching point of a pressure monitor.

The variation of the pressure ratio within the system which occurs with the throttling of the suction flow leads to a final temperature increase. For this reason, the suction pressure due to throttling may be reduced only until the permissible maximum final temperature of the compressed medium is reached.

What the device according to the invention accomplishes is that the throttle valve 18 can be actuated to rotate it through an angle from an open, substantially horizontal position to a temperature-dependent, substantially vertical closed position, without opening of the bleed valve 5. Therefore, a wide range of the occurring load changes is included at little cost with no energy losses occurring due to bleeding of the pumped medium.

Thermostats or pressure ratio monitors initiating idling through the magnetic valve 14 and shutting off the machine when a maximum permissible temperature is reached are used for temperature monitoring.

While a specific embodiment has been shown and described in detail to illustrate the application of the principles of the invention, it will be understood that the invention may be embodied otherwise without departing from such principles.

What is claimed is:

1. A device for regulating the output quantity of a gaseous medium of a compressor system having a suction for the compressors for receiving the gaseous medium and a discharge for the compressors for discharging compressed gaseous medium, comprising:

flow control means in the suction for throttling the flow of the gaseous medium to the compressor system, a control piston connected to said flow control means for actuating the throttling of the flow, a cylinder, said control piston having a piston part disposed within said cylinder defining a first and second chamber on opposite sides thereof, a bleed valve having a passage connected to the discharge and to atmosphere and valve seat means adjacent said passage, valve means connected to said control piston and movable in said passage between a position in which said valve means engages said valve seat means for closing said passage and a position in which said valve means disengages from said valve seat means for opening said passage, a reservoir for holding a liquid, pump means for pressurizing and pumping at least part of the liquid from said reservoir, conduit means connected between said pump means and said cylinder to provide a constant fluid pressure to said first chamber, a pressure regulator connected between said pump means and said cylinder for passing the pressurized liquid from said pump means to said second chamber responsive to the gaseous pressure in the discharge, said pressure regulator being operatively connected to said discharge, a fluid throttle shunt means between said pressure regulator and said control piston for delivering liquid to said reservoir, and said control piston being operative to open and close said passage of said bleed valve and to actuate said flow control means responsive to the fluid pressure in said first and second chambers.

2. A device as claimed in claim 1 wherein said flow control means includes a throttling valve member in said suction movable between open and closed positions.

3. A device as claimed in claim 1, wherein said valve seat means comprises first and second spaced seats in said passage, said valve means comprising first and second valve members engageable with respective first and second valve seats.

4. A device as claimed in claim 2, wherein said valve means includes a valve rod connected between said throttling valve member and said control piston.

5. A device as claimed in claim 2, wherein said valve means includes a connecting stem first and second valve members mounted on said connecting stem, said connecting stem connected to said control piston and having an end remote from said first and second valve members connected to said throttling valve member.

6. A device as claimed in claim 5, wherein said first and second members comprise a single valve part having first and second conical portions, a connecting rod on which said valve part is engaged having an elongated slot therein, the engagement of said valve part with said connecting rod including a pin engaged in said slot comprising a lost motion connection between said valve means and said control piston, said valve part being axially displaceable on said valve stem and spring means preloading said valve part for movement in an axial direction.

7. A device as claimed in claim 5, wherein said valve stem has an elongated slot of a length determining the closing angle of said throttling valve in the amount of lost motion between said valve part and said control piston.

8. A device as claimed in claim 1, further comprising means operatively connected to said fluid throttle shunt means and said reservoir to selectively disconnect said second chamber with said reservoir and connect said second chamber with said pump means responsive to the temperature in said discharge line.

9. A device as claimed in claim 1, wherein said piston part has a first surface area exposed to the pressure in said first chamber and a second surface area exposed to the pressure in said second chamber, and said second surface area being greater than said first surface area.

10. A device for regulating the quantity of medium taken in through a suction for the compressors and discharged through a discharge of th compressors, comprising a throttle valve in the suction having a valve member movable between opened and closed positions, a control piston connected to said throttle valve to move said throttle valve between said opened and closed positions, a bleed valve having a passage connected to said discharge and to the atmosphere, valve seat means in said passage, valve means connected to said control piston and movable in said passage toward and away from said valve seat means for opening and closing said passage, said valve means and said valve seat means providing a lost motion connection to said control piston, said control piston being movable to move said valve means to open said passage only after the throttle is moved in a closing direction and said lost motion connection being thereafter effective to move said valve means in an opening direction, a reservoir for holding a liquid, and pump means for pumping at least a part of the liquid into communication with the control piston to actuate movement thereof, and a pressure regulator connected between said pump means and said control piston for regulating liquid pumped into communication with said control piston responsive to the pressure in the discharge.

* * * * *